United States Patent [19]

Kranz

[11] Patent Number: 4,674,707

[45] Date of Patent: Jun. 23, 1987

[54] APPARATUS FOR STABILIZING A FLYING BODY

[75] Inventor: Walter Kranz, Taufkirchen, Fed. Rep. of Germany

[73] Assignee: Messerschmitt-Boelkow-Blohm Gesellschaft mit beschraenkter Haftung, Munich, Fed. Rep. of Germany

[21] Appl. No.: 796,750

[22] Filed: Nov. 8, 1985

[30] Foreign Application Priority Data

Nov. 24, 1984 [DE] Fed. Rep. of Germany ..... 3442974

[51] Int. Cl.[4] ..... F42B 15/033

[52] U.S. Cl. ..... 244/3.22

[58] Field of Search ..... 244/3.22, 3.21, 170, 244/76 C, 76 J, 3.26

[56] References Cited

U.S. PATENT DOCUMENTS

| | | | |
|---|---|---|---|
| 3,262,655 | 7/1966 | Gillespie | 244/3.21 |
| 3,645,475 | 2/1972 | Stripling | 244/3.22 |
| 3,806,064 | 4/1974 | Parilla | 244/3.22 |
| 3,977,629 | 8/1976 | Tubeuf | 244/3.22 |
| 4,003,531 | 1/1977 | Fink | 244/3.22 |

FOREIGN PATENT DOCUMENTS 2856286 12/1978 Fed. Rep. of Germany .

*Primary Examiner*—Stephen C. Bentley
*Assistant Examiner*—Stephen M. Johnson
*Attorney, Agent, or Firm*—W. G. Fasse; D. H. Kane, Jr.

[57] ABSTRACT

The flight path of a flying body, such as an artillery shell, is stabilized against disturbing forces and against pendulum type motions by fluid steering jets ejected from said flying body for causing forces countering the disturbing forces. The steering jets pass through a fluid jet distributing member which has inlet openings communicating with fluid ducts leading to a fluid supply chamber. The distributing member is mounted in the flying body by a spring which permits a deflection or shifting of the distributing member in a direction across a central longitudinal axis of the body. A shift increases the fluid flow cross-sectional area at the inlet openings of the distributing member on its side opposite a disturbing force and decreases the fluid flow cross-sectional area on the side on which the disturbing force is effective, whereby the through-flow of fluid is increased on the opposite side and decreased on the side on which the disturbing force is effective on said flying body for generating the compensating force.

7 Claims, 2 Drawing Figures

APPARATUS FOR STABILIZING A FLYING BODY

FIELD OF THE INVENTION

The invention relates to an apparatus for stabilizing a flying body and to reduce any pendulum type of movements of such a body. More specifically, the invention relates to flying bodies travelling at supersonic speeds such as artillery shells and the like. The stabilization is accomplished with fluid control jets for producing a cross force which counteracts a pendulum type of movement. The fluid control jets also referred to as steering jets, produce a cross force which counteracts any pendulum movements. The steering jets are blown out of the flying body through blow openings which are distributed around the circumference of the flying body in a rotationally symmetric manner. These steering jets are directed substantially or approximately in a radial direction relative to a longitudinal central axis of the flying body and are blown into the supersonic air stream which flows around the flying body.

DESCRIPTION OF THE PRIOR ART

It is known from theoretical and experimental investigations that the fluid steering or control jets which are blown out of the flying body into the supersonic air stream produce a cross-acting force. Mostly, these steering jets are blown in a direction including an angle relative to the longitudinal central axis of the flying body. Such angle extends normally at 90° to the central axis of the flying body or it may slant up to 30° relative to the onflow direction. It has been calculated that such cross force generated at supersonic flying speeds is two to three times larger than the cross force that can be calculated by applying the momentum theorem in such calculations. Such substantial increase in the cross force is due to the formation of a burbling region and due to a shock induced excess pressure, both of which result from the supersonic air flow around the flying body. The size of the cross force depends on the location of the respective blow openings on the contour of the flying body relative to the center of gravity of the flying body. Additionally, the size of the cross force depends on the speed of the air stream at the location of the fluid steering jet. Thus, the size of the cross force also depends on the local Mach number.

It is known from German Patent Publication (DE-OS) No. 2,856,286 to locate substantially radially directed jet nozzles or jet slots in the jacket of the flying body, whereby these jet nozzles or jet slots are arranged upstream and/or downstream of the center of gravity of the flying body. These jet nozzles or jet slots are directed substantially radially relative to a longitudinal central axis of the flying body. Control elements are provided for connecting the jet nozzles or jet slots with a source of fluid. Air flowing into a central channel in the flying body may be used as a source of fluid for this purpose. The fluid control elements guide the fluid from the fluid source to the individual jet nozzles or jet slots in response to the pressure which is being measured through pressure ducts at the flying body jacket. In this manner a cross force is generated which counteracts any pendulum type of movement of the flying body. Such cross force is effective until the onflow direction again extends in parallel to the longitudinal central axis of the flying body.

For target hitting accuracy reasons it is necessary that the cross force must be determined very precisely.

In other words, the dimensions of the individual control elements and jet nozzles must be precisely correlated or tuned to the throughput of jet fluid coming from the fluid source in order to produce cross forces which precisely counteract any pendulum type of movement and in order to avoid producing any additional disturbing cross forces which might cause a further pendulum movement or which might even cause a flip over of the flying body. Due to these requirements, the control technical efforts and expenditures are rather high in the prior art apparatus.

OBJECTS OF THE INVENTION

In view of the above it is the aim of the invention to achieve the following objects singly or in combination:

to construct an apparatus for stabilizing the flight of a flying body, more specifically, for counteracting any pendulum type of movements of the flying body, which apparatus is simple in its construction and which does not require any complicated or highly precise dimensioning, yet achieves a highly accurate effect and a highly sensitive control of the flight path of the flying body;

to spring mount a fluid flow control body and to dimension the mounting spring or springs in such a way that it is very sensitive to lateral cross forces; and to steer a flying body travelling at supersonic speeds so that any disturbing forces are rapidly counteracted to quickly return the flying body into the ideal, desired flight condition or flight path.

SUMMARY OF THE INVENTION

The stabilizing apparatus according to the invention is characterized by the following features. The blowout or outlet openings are located in a fluid jet distributing member having a longitudinal axis normally coinciding with the longitudinal central axis of the flying body. The fluid jet distributing member is mounted in the flying body by a spring arrangement in such a way that it is displaceable or shiftable in all directions extending across the longitudinal central axis of the flying body. The blowing or outlet openings of the fluid jet distributing member communicate with passage inside the member. These passages extend substantially in an axial direction and then form a deflection or or knee type bend extending approximately radially relative to the longitudinal axis. The outlet openings pass through a lateral wall of the distributing member. The passages inside the distributing member lead to a fluid source through supply ducts and channels, whereby the flow cross-sectional area between the supply ducts and inlet openings into the passages in the distributing member have a certain cross-sectional size when the distributing member is in its normal position. In such normal position the degree of overlap between the supply ducts and the inlet openings into the distributing member is uniform all around the distributing member. Thus, when the distributing member is in the normal position in which its rotational axis coincides with the longitudinal central axis of the flying body, all blowing or outlet openings discharge fluid steering jets all of which have the same effect. On the other hand, when a disturbing cross force is effective on the flying body, the degree of overlap changes due to the shifting of the distributing member in such a way that the fluid throughput through the blowing openings on the side of the flying body on which the disturbing force is effective, is reduced while the fluid throughput is increased on the opposite side. Thus, according to the invention two features are used in cooperation. The first feature involves blowing steering fluid jets out of all blowing or outlet openings during the entire time when stabilization is required. Thus, when all flight conditions are normal and no disturbing forces are effective on the flying body so that the distributing member is in its coaxial position, all fluid nozzles discharge the same fluid throughput. As a result, all of the respective steering jets have the same effect. The cross forces caused by these uniform jets are all the same so that the resultant is zero. On the other hand, when due to a disturbing cross force the flying body changes its angle of attack, the resulting different onflow speeds on the windward side and on the leeward side produce steering jets which in turn produce cross forces tending to automatically counteract any pendulum type of movement of the flying body and to return the flying body into the ideal flight condition. The flying body is thus kept on course by the steering fluid jets which hold the flying body in the manner of a spring which is effective in the onflow direction on all sides. This type of stabilizing is very sensitive and hence quickly responsive to disturbing forces.

On the other hand, the just described automatic stabilizing is effectively enhanced by the fluid jet distributing member according to the invention which functions as a spring supported inertia body. If a disturbing force is effective on the flying body, the fluid jet distributing member reacts, due to its inertia mass, with a time delay to the cross acceleration resulting from such a crosswise effective disturbing force, whereby the distributing member lags behind the pendulum type of motion of the flying body. As a result, the above mentioned degree of overlap between the stationary fluid supply ducts inside the flying body and the inlet openings into the flow passages through the distributing member is changed in such a way that the out blowing openings on the side opposite the side on which the disturbing force is effective receive more fluid than the side on which the disturbing force is effective. As a result, stronger jets are ejected on said opposite side and smaller jets are ejected on the side on which the disturbing force is effective, whereby an automatic counteraction tends to neutralize any tendency of the flying body to perform pendulum motions.

By providing a bend or deflection knee in the flow passages passing from respective inlet openings to respective outlet openings through the distributing member, the ejected fluid jet imparts a thrust to the distributing member. This thrust is effective in the same direction as the inertia of the distributing member in response to a disturbing force. In other words, the change in the degree of overlap caused by the inertia of the distributing member is enhanced by said thrust. Thus, the correction of the flight path to its desired or ideal direction takes place rapidly.

The above mentioned, figuratively intended spring holds the flying body on all sides and the spring is biased in the onflow direction, whereby the spring strength is increased on the side of the flying body opposite the disturbing force, thereby increasing the counter force exerted by the spring on the flying body and this increase in the spring strength is caused by the inertia of the distributing member and by the thrust effect of the steering fluid jets passing through the larger flow cross-sectional area on the side opposite to the side on which the disturbing force is effective.

It must be taken into account, however, that the disturbing force is also effective on surfaces of the distributing member which are exposed to the outlet ports in the jacket of the flying body. Thus, the disturbing force tends to counteract any relative motion of the distributing member inside the flying body housing. Accordingly, the exposed surfaces of the distributing member or rather, the outlet ports in the jacket of the flying body must be kept so small that the movements of the distributing member due to inertia remain dominant as compared to any movements that may be caused by a disturbing force directly effective on exposed surface areas of the distributing member. Specifically, the exposed surfaces of the distributing member should thus be limited to the immediate vicinity of the outlet ports in the jacket of the flying body. These outlet ports as such are relatively small anyway.

The outlet openings or blow openings of the distributing member may have various shapes and forms. Thus, holes may be used as well as hole patterns and slots or even ring slot sections may be employed.

Preferably, the distributing member is mounted inside the flying body with a tubular spring extending coaxially to the longitudinal central axis of the flying body. The tubular spring may be open toward a tip of the flying body if the stabilizing apparatus is installed in the flying body tip. This feature has the advantage that the spring stiffness of the mounting spring depends on the onflow speed of the air through which the flying body is travelling. Thus, the mounting spring acts, so to speak, as a Mach adapter.

BRIEF DESCRIPTION OF THE DRAWINGS

In order that the invention may be clearly understood, it will now be described, by way of example, with reference to the accompanying drawings, wherein.

Figure 1:
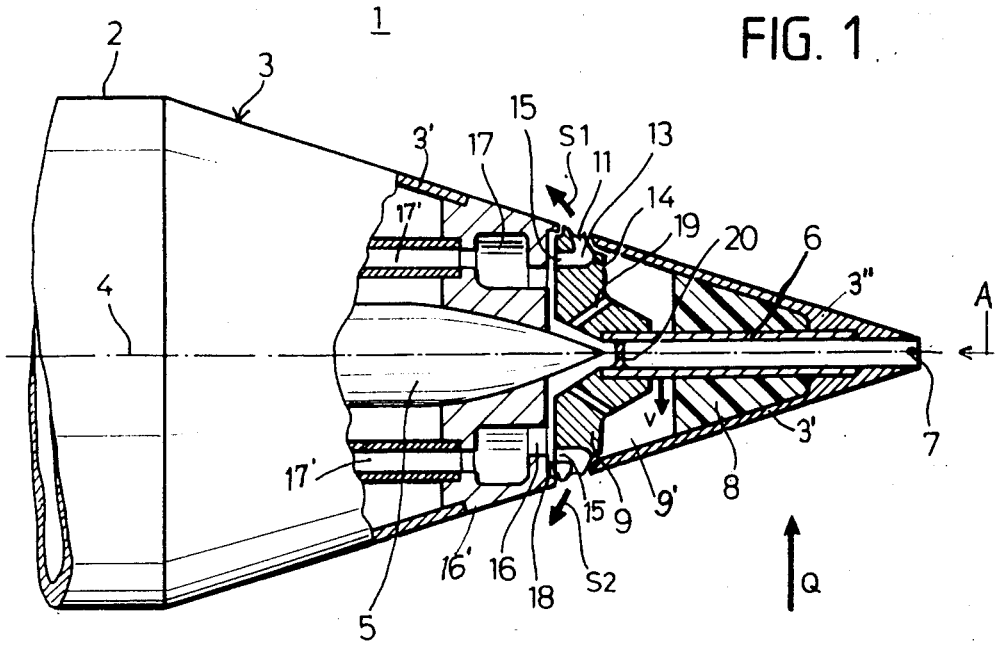
FIG. 1 is a sectional view through a stabilizing apparatus according to the invention along section line 1—1 in FIG. 2 and showing the tip of an artillery shell.

DETAILED DESCRIPTION OF PREFERRED EXAMPLE EMBODIMENTS AND OF THE BEST MODE OF THE INVENTION

Fig. illustrates a portion of an artillery shell 1 having a cylindrical housing 2 and a conical tip 3. The longitudinal axis 4 of the shell runs centrally through the shell from tip to toe. A coaxially located impact core 5 is intended to penetrate a target. The shell tip 3 has a jacket 3' provided with a bore 7 extending coaxially with the shell and opening directly at the front end 3'' of the tip. The bore 7 thus functions as a Pitot head or tube. A tubular spring 6 is mounted coaxially to the bore 7 in the jacket tip end 3''. Only the front end of the tubular spring 6 is held in place and the rear end of the spring 6 is free to yield in directions extending across the central axis 4. A certain length of the spring 6 is surrounded by a body 8 of a damping material which, together with the spring 6 forms a spring/damping system or mass. The body 8 is also secured to the inner surface of the jacket 3' near the tip end 3''. Body 8 may be rubber.

Figure 2:
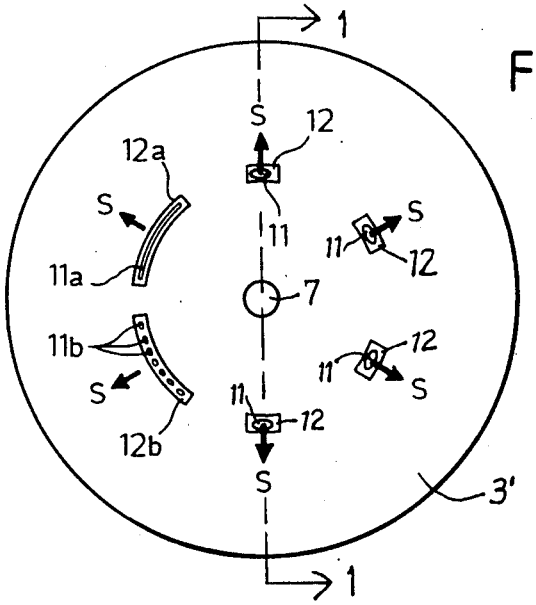
FIG. 2 is a view in the direction of the arrow A in FIG. 1 onto the tip of the artillery shell.

A fluid jet distributing member 9 is operatively secured to the free, rear end of the spring 6 which is free to move in the direction indicated by the arrow v. The outer contour of the distributing body 9 is adapted to the shape of the jacket 3'. However, the outer surface of the distributing body 9 is substantially covered by the jacket 3', except for the outlet ports 12, 12*a*, and 12*b* as best seen in FIG. 2.

The fluid jets distributing member 9 comprises a plurality of jet blowing nozzles or outlet openings 11 which are equally distributed around the circumference of the shell jacket 3' at uniform angular spacings. In the example six such blowing nozzles or outlet openings 11 are provided. The outlet ports 12, 12*a*, 12*b* are just slightly larger than the blowing nozzles 11, 11*a*, 11*b* so that very small surface areas of the distributing member 9 are exposed, please see FIG. 2. The blow nozzles or outlet openings 11 merge into flow passage sections 13 in the distributing member 9. The flow passage sections 13 in turn merge into respective inlet openings 15 in the member 9. The flow passage sections 13 have a first portion extending substantially or approximately radially relative to the axis 4 and a second portion extending approximately in parallel to the axis 4. Thus, a bend 14 is formed in each flow passage section 13. The inlet openings 15 communicate with a fluid duct or rather with a plurality of fluid ducts 16 leading into a ring channel 17 which in turn communicates with a fluid supply chamber 17'. The ducts 16 and the ring channel 17 are located in an intermediate member 16'. The chamber 17' is connected, for example, to a conventional gas generator not shown.

An intermediate gap 18 is provided between the fluid jet distributing member 9 and the intermediate member 16' for permitting the free movability of the member 9 in response to a deflection of the tubular spring 6. Additionally, any excess gas may pass through this gap 18 and compensation channels 19 into a chamber 9' which leads to the outside through the outlet ports 12. The inlet openings 15 of the fluid flow passage sections 13 in the member 9 have a certain defined fluid flow cross-sectional area. Depending on the instantaneous position of the member 9 the actual flow through cross-sectional area may be about 50 to 80% of the entire flow through area. In other words, there is a certain overlap of the inlet openings 15 by the opposite surface of the intermediate member 16' across the gap 18. This overlap would then be in the range of 50 to 20%. This degree of overlap is the same for all flow passage sections 13 as long as the member 9 is in its coaxial, central position relative to the axis 4. As a result, all blow nozzles or outlet openings 11 discharge fluid jets of the same strength which are accordingly equally effective. These fluid jets are indicated by the arrows S1 and S2 in FIG. 1 and by the arrow S in FIG. 2. The fluid jets may, for example, be hot gas jets.

In operation, when the shell 1 is flying through the air, a disturbing force Q may be effective on the flying shell. The disturbing force Q may, for example, be a wind force tending to deflect the shell upwardly in FIG. 1. Due to its mounting by the tubular spring 6, and due to its inertia, the distributing member 9 follows the acceleration caused by the disturbing force Q only with a certain time delay. In other words, the member 9 moves in the direction of the arrow v relative to the flying body or shell 1 and thus in a direction opposite to the direction of the disturbing force Q. As a result, the upper inlet opening 15 is moved toward the axis 4 and the respective lower inlet opening 15 is moved away from the central axis 4, whereby the degree of overlap is reduced at the upper inlet opening 15, and the degree of overlap at the lower inlet opening 15 is increased. Stated differently, the fluid flow throughput through the upper opening 15 is increased and decreased through the lower inlet opening 15. As a result, the force generated by the hot gas jet S1 is increased thereby counteracting the disturbing force Q to return the shell 1 into its proper flight path. Simultaneously, the force of the lower hot gas jet S2 is decreased. Simultaneously, the hot gas jet S1, due to the bend 14 in the flow passage section 13 exerts a thrust on the distributing member 9 so that the movement of the member 9 in the direction of the arrow v is supported or enhanced. As soon as the disturbing force Q disappears, the member 9 returns automatically into its coaxial central position as shown in FIG. 1 under the action of the spring 6. That position indicates that any disturbing forces are zero or absent and that the shell is on its ideal, target oriented flight path.

The example embodiment of FIG. 1 shows that the rear end of the tubular spring is closed by a stopper 20, whereby a certain pressure head is built up inside the bore 7 and inside the tubular spring 6. This feature has the beneficial result that the stiffness of the tubular spring 6 increases the faster the shell flies.

The facing view of the shell 1 shown in FIG. 2 illustrates that the outlet ports 12 are only slightly larger than the nozzle openings 11 in order to keep the exposed surface of the fluid jet distributing member 9 as small as possible. Thus, any direct effect of any crosswise disturbing forces Q is minimized. FIG. 2 shows several types of nozzle openings 11, 11*a* and 11*b* surrounded by respectively shaped outlet ports 12, 12*a*, 12*b*. For example, outlet nozzle holes 11*a* form a slot surrounded by a slot 12*a* in the jacket 3'. A row of blow nozzles 11*b* form a curved hole pattern in a slot 12*b*. The same or different types of nozzle holes and respective outlet ports may be used in the same shell or in different shells.

In the described example embodiment the stabilizing mechanism is installed in the tip of the shell. However, the mechanism may also be installed in the rear end of the shell or in any other suitable location within the shell.

Although the invention has been described with reference to specific example embodiments, it will be appreciated, that it is intended, to cover all modifications and equivalents within the scope of the appended claims.

What I claim is:

1. An apparatus for stabilizing a flying body, especially a flying body travelling at supersonic speeds, said flying body having a longitudinal central axis and fluid flow passages including outlet ports leading from inside said flying body to the outside of said flying body for blowing stabilizing fluid jets into an air flow through which said flying body is passing, said fluid jets extending approximately radially relative to said longitudinal central axis, said apparatus further comprising an internal fluid jet distributing member having a rotational axis normally coinciding with said longitudinal central axis, said fluid flow passages having flow passage sections located in said fluid jet distributing member and including inlet openings and outlet openings for said flow passsage sections, spring means mounting said fluid jet distributing member in said flying body for permitting shifting said fluid jet distributing member in any direction extending across said central axis, fluid chamber means inside said flying body for providing a supply of blow fluid, fluid duct means located between said chamber means and said fluid jet distributing member, said inlet openings of said flow passage sections in said fluid jet distributing member uniformly overlapping said fluid duct means when said fluid jet distributing member is in a central, coaxial position relative to said central axis, so that all overlapping flow cross-sectional areas of said inlet openings into said flow passage sections are of the same size for uniformly communicating said fluid chamber means with said outlet ports when said fluid jet distributing member is in said central, coaxial position, said inlet openings of said flow passage sections overlapping said fluid duct means in a non-uniform manner when said fluid jet distributing member is in an off-center position relative to said central axis, so that all overlapping flow cross-sectional areas into said flow passage sections are of different sizes for non-uniformly communicating said fluid chamber means with said outlet ports when said fluid jet distributing member is in said off-center position, said spring means mounting said fluid jet distributing member being automatically responsive to a disturbing force effective on one side of said flying body in a direction across said longitudinal central axis for causing said spring means to shift said fluid jet distributing member laterally for increasing the size of said overlapping flow cross-sectional areas on another side of said flying body and simultaneously decreasing the size of said overlapping flow cross-sectional areas on said one side of said flying body for counteracting said disturbing force by an increased fluid discharge through said outlet ports on said other side to prevent pendulum type of movements of said flying body.

2. The apparatus of claim 1, wherein said spring means for mounting said fluid jet distributing member comprises a tubular spring extending coaxially relative to said longitudinal central axis for normally holding said fluid jet distributing member in a central coaxial position.

3. The apparatus of claim 1, wherein said flying body has holes (12) in its outer walls forming said outlet ports, said outlet openings (11) of said fluid jet distributing member being smaller than said outlet ports (12), whereby only a small surface area of said fluid jet distributing member is exposed outwardly through said holes (12).

4. The apparatus of claim 1, wherein said fluid jet distributing member comprises compensation channels (19) for returning any excess fluids into said fluid chamber means.

5. The apparatus of claim 1, further comprising a ring channel interconnecting said fluid duct means leading from said chamber means to said inlet openings of said fluid jet distributing member.

6. The apparatus of claim 1, wherein said outlet openings of said flow passage sections in said fluid jet distributing member comprise six such outlet openings evenly distributed about said central axis in a rotationally symmetric manner.

7. The apparatus of claim 1, wherein said flow passage sections in said fluid jet distributing member have a first portion extending approximately in parallel to said longitudinal central axis, a second portion extending approximately radially relative to said longitudinal central axis, and a third portion forming a knee bend interconnecting said first and second portions for exerting a deflection thrust on said fluid jet distributing member.

* * * * *